US006557959B1

(12) United States Patent
King

(10) Patent No.: US 6,557,959 B1
(45) Date of Patent: May 6, 2003

(54) CABINET DOOR HINGE WITH STRAIN RELIEF STRUCTURE

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 1 day.

(21) Appl. No.: 09/870,237

(22) Filed: May 30, 2001

Related U.S. Application Data

(63) Continuation-in-part of application No. 09/542,982, filed on Apr. 4, 2000.

(51) Int. Cl.[7] ..... A47B 49/00; A47B 88/00

(52) U.S. Cl. ..... 312/326; 312/327; 312/329; 16/335; 16/361

(58) Field of Search ..... 312/326, 327–329; 16/361, 326, 335

(56) References Cited

U.S. PATENT DOCUMENTS

| | | | | | |
|---|---|---|---|---|---|
| 2,132,266 | A | * | 10/1938 | Lefevre | 16/135 |
| 3,066,349 | A | * | 12/1962 | Youngdale | 16/135 |
| 4,096,602 | A | * | 6/1978 | Nelson | 126/191 |
| RE30,717 | E | | 8/1981 | Dargene | 16/135 |
| 4,517,706 | A | | 5/1985 | Lautenschläger et al. | 16/238 |
| 4,615,072 | A | | 10/1986 | Lautenschläger, Jr. | 16/238 |
| 4,698,877 | A | | 10/1987 | Lautenschläger, Jr. et al. | 16/235 |
| 4,703,539 | A | | 11/1987 | Lautenschläger, Jr. et al. | 16/240 |
| 4,704,766 | A | | 11/1987 | Almestad | 16/236 |
| 4,716,622 | A | * | 1/1988 | DeBruyn | 16/297 |
| 4,799,290 | A | | 1/1989 | Lautenschläger, Jr. | 16/237 |
| 4,976,006 | A | | 12/1990 | Lautenschläger | 16/238 |
| 5,052,077 | A | | 10/1991 | Lautenschläger et al. | 16/238 |
| 5,067,200 | A | | 11/1991 | Stowell et al. | 16/237 |
| 5,103,532 | A | | 4/1992 | Youngdale et al. | 16/288 |
| 5,108,165 | A | | 4/1992 | Rorke et al. | 312/322 |
| 5,327,616 | A | | 7/1994 | Lautenschläger | 16/382 |
| 5,355,557 | A | * | 10/1994 | Cress et al. | 16/286 |
| 5,375,297 | A | | 12/1994 | Lautenschläger et al. | 16/249 |
| 5,392,493 | A | | 2/1995 | Youngdale | 16/237 |
| 5,511,287 | A | | 4/1996 | Lautenschläger et al. | 16/239 |
| 5,517,724 | A | * | 5/1996 | Beneke | 16/278 |
| 5,577,296 | A | | 11/1996 | Grass | |
| 5,655,261 | A | * | 8/1997 | Cress | 16/286 |
| 5,737,804 | A | * | 4/1998 | Ferrari et al. | 16/242 |
| RE36,213 | E | | 6/1999 | Lautenschläger et al. | 16/249 |
| 6,125,508 | A | * | 10/2000 | Formenti | 16/278 |
| 6,237,191 | B1 | * | 5/2001 | Ferrari et al. | 16/286 |
| 6,286,918 | B1 | * | 9/2001 | King | 16/382 |
| 6,289,556 | B1 | * | 9/2001 | Salice | 16/242 |
| 6,314,616 | B1 | * | 11/2001 | King | 16/237 |
| 6,360,401 | B1 | * | 3/2002 | Salice | 16/284 |
| 6,401,298 | B1 | * | 6/2002 | Lenz | 16/303 |

FOREIGN PATENT DOCUMENTS

DE 4405349A-1 8/1995

OTHER PUBLICATIONS

Pages 93 and 112–114 of the 1998 Charles McMurray Catalog.

* cited by examiner

*Primary Examiner*—Anthony Knight
*Assistant Examiner*—John B. Walsh
(74) *Attorney, Agent, or Firm*—Thomas R. Lampe

(57) ABSTRACT

A hinge member attached to a cabinet housing and a hinge member attached to a cabinet door are hingedly interconnected by a connector which includes structure for relieving strain on the cabinet housing when the cabinet door is moved further than its normally open position.

7 Claims, 4 Drawing Sheets

CABINET DOOR HINGE WITH STRAIN RELIEF STRUCTURE

This application is a continuation-in-part of U.S. patent application Ser. No. 09/542,982, filed Apr. 4, 2000.

TECHNICAL FIELD

This invention relates to a hinge construction for use with cabinets incorporating a strain relief feature which prevents damage to a cabinet housing when a cabinet door connected to the housing by the hinge is opened beyond its normal open position. In the embodiment illustrated herein, the invention is incorporated or employed in a face frame cabinet, however, the invention has applicability to other types of cabinet constructions.

BACKGROUND OF THE INVENTION

Hinges for connecting cabinet doors to cabinets per se are a well known and common expedient. Many hinge arrangements have been devised over the years, including hinge constructions employed with face frame cabinets.

The following patents and materials are believed to be representative of the current state of the prior art in this field: U.S. Pat. No. 5,067,200, issued Nov. 26, 1991, U.S. Pat. No. 4,703,539, issued Nov. 3, 1987, U.S. Pat. No. 5,511,287, issued Apr. 30, 1996, U.S. Pat. No. 4,799,290, issued Jan. 24, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE.36,213, issued Jun. 1, 1999, U.S. Pat. No. RE.30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issue Nov. 10, 1987, and U.S. Pat. No. 4,976,006, issued Dec. 11, 1990. A frameless cabinet door hinge is disclosed in German Offenlegungsschrift DE 4405349A1. Other hinges of some degree of relevance are shown in pages 93 and 112–114 of the 1998 Charles McMurray Catalog.

Certain types of prior art hinge constructions can cause serious damage to the cabinets with which they are associated when the cabinet door is pushed beyond its normal open position. The above-identified prior art does not address this problem nor does it disclose or suggest the combination of structural elements disclosed and claimed herein.

DISCLOSURE OF INVENTION

The present invention includes a first hinge member for attachment to a cabinet housing and a second hinge member for attachment to a cabinet door employed to selectively cover an opening in the cabinet housing.

Connector means hingedly interconnects the first hinge member and the second hinge member whereby the cabinet door may be pivoted relative to the cabinet housing between a closed position wherein the cabinet door covers the cabinet opening and a predetermined open position wherein the cabinet door does not cover the cabinet opening.

The connector means includes strain reliever means for relieving strain on the cabinet housing when the cabinet door has a force applied thereto when the cabinet door is in the predetermined open position further pivoting the cabinet door away from the cabinet opening and moving the cabinet door beyond the predetermined open position.

Other features, advantages and objects of the present invention will become apparent with reference to the following description and accompanying drawings.

MODE FOR CARRYING OUT THE INVENTION

For purposes of illustration, the present invention is illustrated and described as being utilized with a face frame cabinet; however, it will be appreciated that the principles of the invention can be utilized with other types of cabinets.

Referring now to FIGS. 1–11, a portion of a face frame cabinet is illustrated, the cabinet including a cabinet wall 10 and a frame member 12 attached to the cabinet wall. The drawings also show a cabinet door 14 hingedly connected to the frame member in accordance with the teachings of the present invention.

Figure 1:
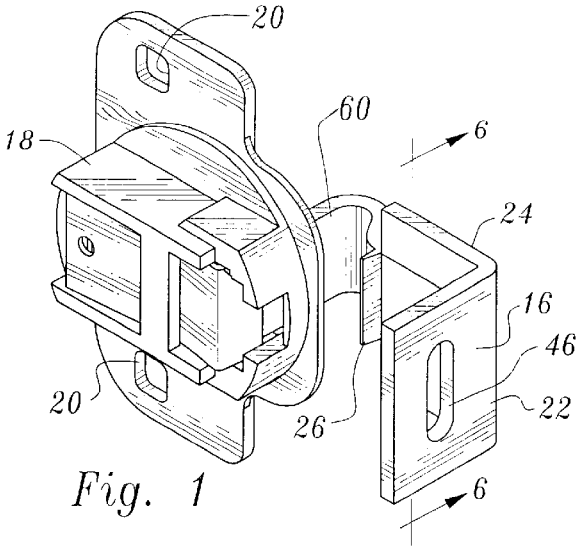
FIG. 1 is a frontal perspective view of apparatus constructed in accordance with the teachings of the present invention, including first and second hinge members and a connector.
Figure 2:
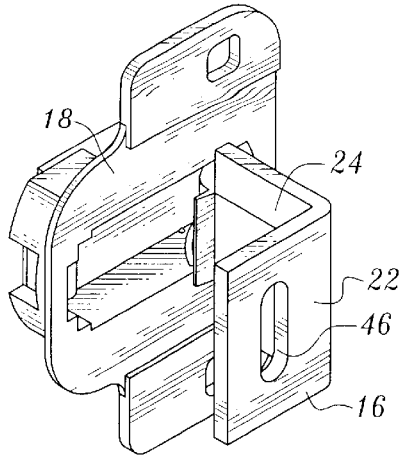
FIG. 2 is a rear perspective view of the apparatus.
Figure 3:
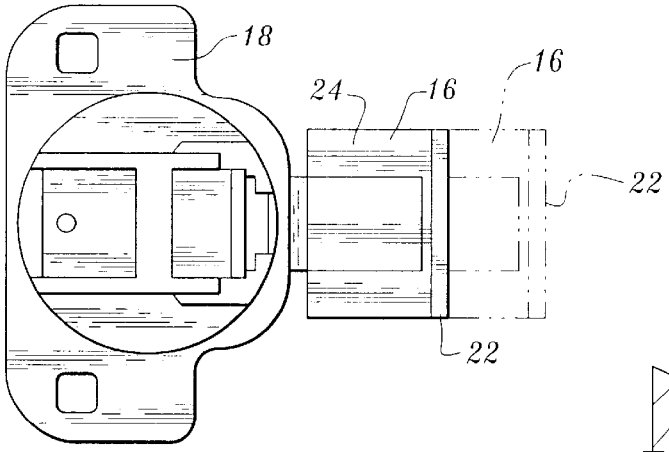
FIG. 3 is an elevational view of the apparatus showing the hinge members in two different relative positions.
Figure 4:
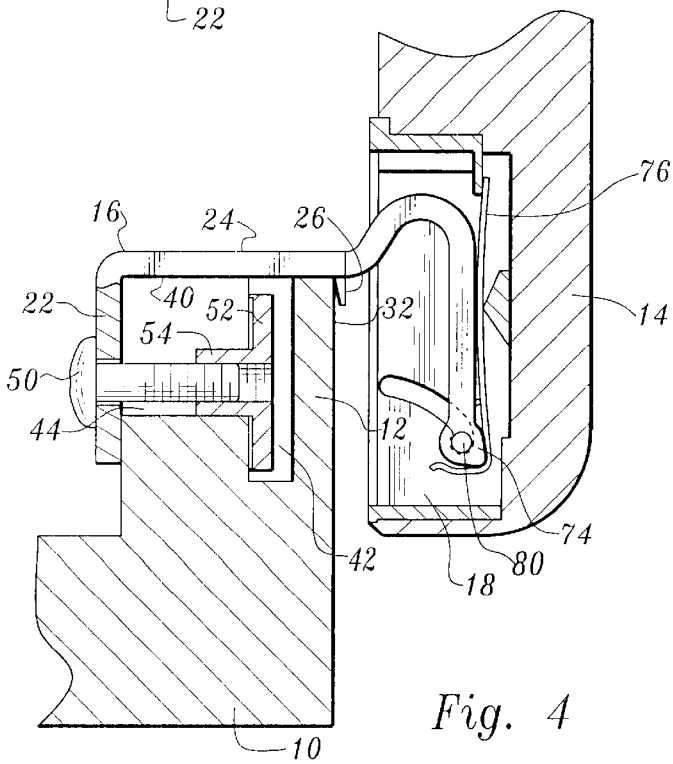
FIG. 4 is a top plan view in partial cross-section illustrating the hinge members mounted on a face frame cabinet including a cabinet housing and a cabinet door, the door being shown in closed position.

The apparatus of the present invention includes a hinge having a first hinge member 16 and a second hinge member 18 pivotally connected to the first hinge member. The illustrated second hinge member 18 has a cup-like configuration and is of a type well known in the prior art which is received in an opening or recess in a cabinet door as shown in FIG. 4, for example, and secured thereto by screws (not shown). The screws pass through rectangular openings 20 formed in the second hinge member. The rectangular openings are in the form of squares with rounded corners and are bigger than the screw shafts to allow adjustment of the hinge relative to the door before tightening the screws.

The first hinge member 16 includes plates 22, 24 extending orthogonal relative to one another. The plates 22, 24 are integrally connected to one another, an abutment 26 projecting outwardly from the first hinge member 16. When the hinge member 16 is installed and placed on the frame member 12, the frame member is disposed between plate 22 and abutment 26.

Frame member 12 has a frame member front 32, a frame member back 34 and a frame member side 36 disposed between the frame member front and the frame member back.

The frame member side has a T-shaped opening 40 formed therein having a vertical opening segment and an intersecting horizontal opening segment. The vertical opening segment communicates with a recess 42 in the frame member located between the frame member front and frame member back. The horizontal opening segment communicates with a slot 44 formed in the frame member back and communicating with the recess. The slot has a vertical dimension less than the vertical dimension of the recess. This arrangement is disclosed in my co-pending U.S. patent application Ser. No. 09/542,982, filed Apr. 4, 2000.

When the mounting bracket is in position on the frame member 12, plate 24 is disposed parallel and adjacent to the frame member side and covers the T-shaped opening. The plate 22 is disposed parallel and adjacent to the frame member back and at least partially covers the slot 44. An opening in the form of an elongated mounting slot 46 is formed in the plate 22.

A mechanical fastener is employed to secure the hinge member 16 to frame member 12. The fastener includes a threaded bolt 50 which projects through plate opening 46 and into slot 44 of the frame member 12. The elongated opening 46 of the plate allows the first hinge member to be adjustably positioned relative to the frame member at the time of installation.

Figure 5:
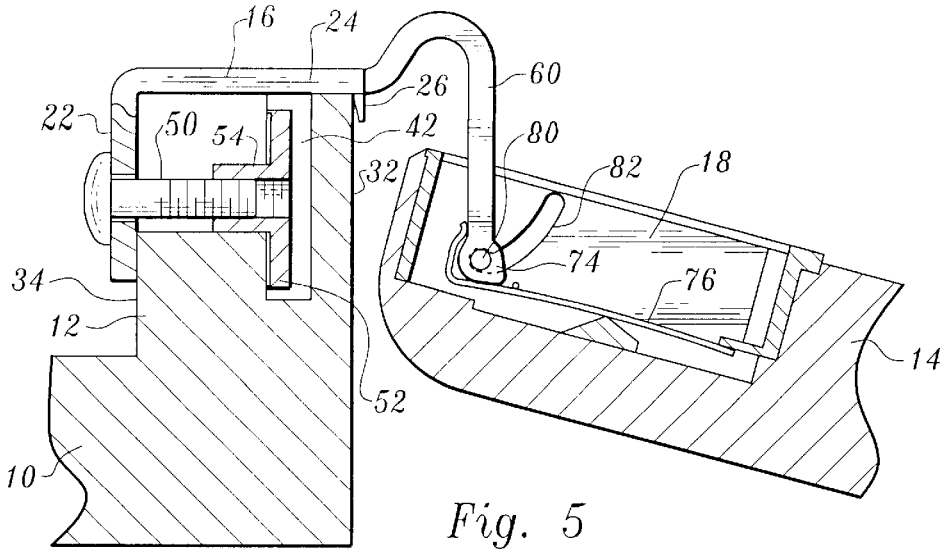
FIG. 5 is a view similar to FIG. 4 but illustrating the door moved to its normal open position.
Figure 6:
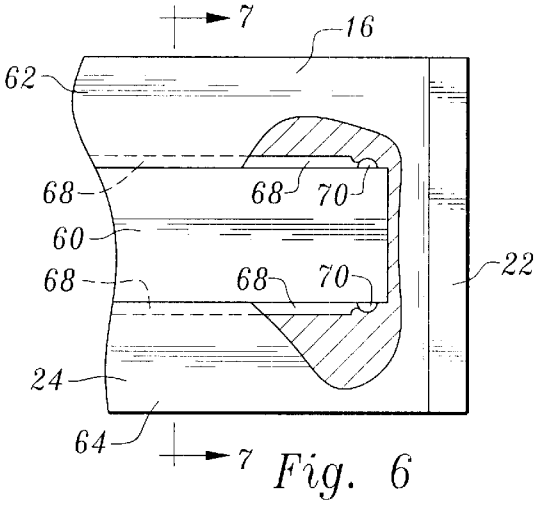
FIG. 6 is a partial sectional view illustrating portions of selected components of the apparatus as taken in the direction of double headed arrow 6—6 in FIG. 1.
Figure 7:
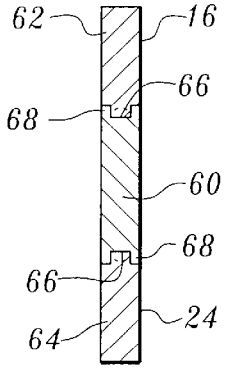
FIG. 7 is an enlarged cross-sectional view taken along line 7—7 of FIG. 6.

The other component of the fastener is a fastener plate 52 disposed in recess 42. A boss 54 projects from the fastener plate into slot 44. Internal threads are formed in the boss and fastener plate. After the structural components are properly positioned, the bolt and fastener plate/boss combination are tightened together, urging the fastener plate in the direction of the first plate 22 so that the portion of the frame member 12 defining slot 44 is clamped between the plate 52 and the plate A unique arrangement is employed to hingedly interconnect the first hinge member 16 and the second hinge member 18 whereby the cabinet door may be pivoted relative to the cabinet housing between a closed position (shown in FIG. 4) wherein the cabinet door covers the cabinet opening defined by the frame member 12 and a predetermined open position wherein the cabinet door does not cover the cabinet opening. This latter position is shown in FIG. 5. In such position the cabinet door defines a predetermined angle with the frame member front 32 of the cabinet housing. The end of the cabinet door is spaced from the front of the cabinet.

The connector means hingedly interconnecting the first hinge member and the second hinge member includes a connector member 60 which is telescopically connected to the first hinge member 16. More particularly, the plate 24 of the first hinge member 16 is bifurcated along a portion of the length thereof. This may perhaps be seen most clearly in FIGS. 6, 7 and 10. The bifurcated segments 62, 64 define channels 66 which receive ribs 68 formed on the sides of connector member 60. The connector member 60 may thus slide relative to the plate 24 in the absence of a restraining force applied thereto from the telescoped position shown in FIGS. 5–8, for example, to the extended position shown in FIGS. 9–11. Detents 70 formed at the distal end of connector member 60 are yieldably positioned in indents formed in plate 24 when the connector member is in the position shown in FIGS. 5 and 6, for example. However, if sufficient pulling forces are applied to connector member 60, it will move to the position shown in FIGS. 9, 10 and 11.

The connector member 60 forms a bend and the end of the connector member remote from detents 70 is in the shape of a cam 74, the cam 74 located in the recess of cup-shaped second hinge member 18. Also disposed in the recess of the second hinge member is a leaf spring 76 which yieldably bears against cam 74. Cam 74 and leaf spring 76 form a yieldable stop, yieldably retaining the second hinge member 18 and cabinet door 14 in the position shown in FIG. 5 until sufficient forces are applied to the cabinet door to either reclose the door or open it to an even greater extent. Pins 80 project from opposed sides of the cam 74 of connector member 60. The pins project into curved slots 82 formed by second hinge member 18 to maintain an interconnection between the second hinge member and the connector member 60.

Figure 8:
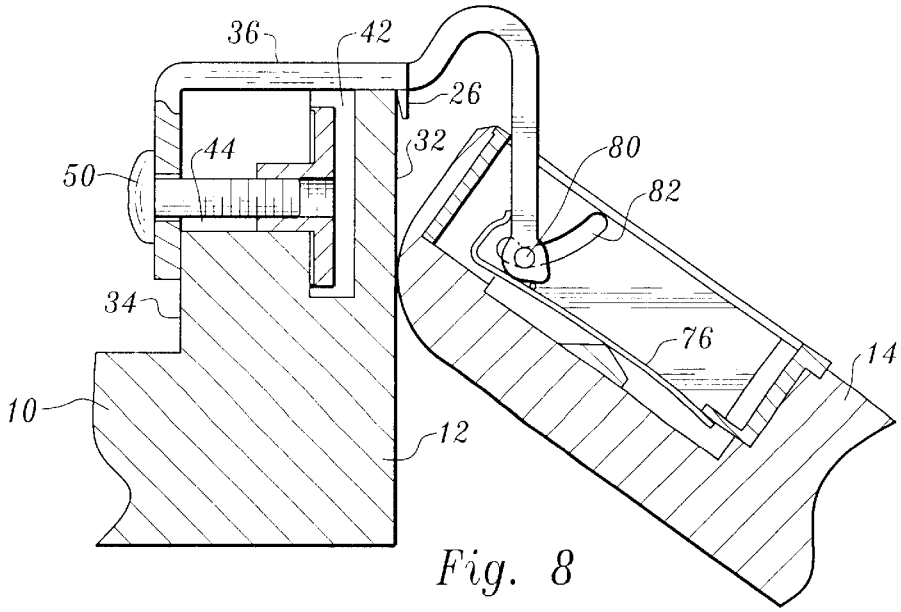
FIG. 8 is a view similar to FIG. 5 but illustrating the door opened beyond its normal open position, the latter being represented in FIG. 5.
Figure 9:
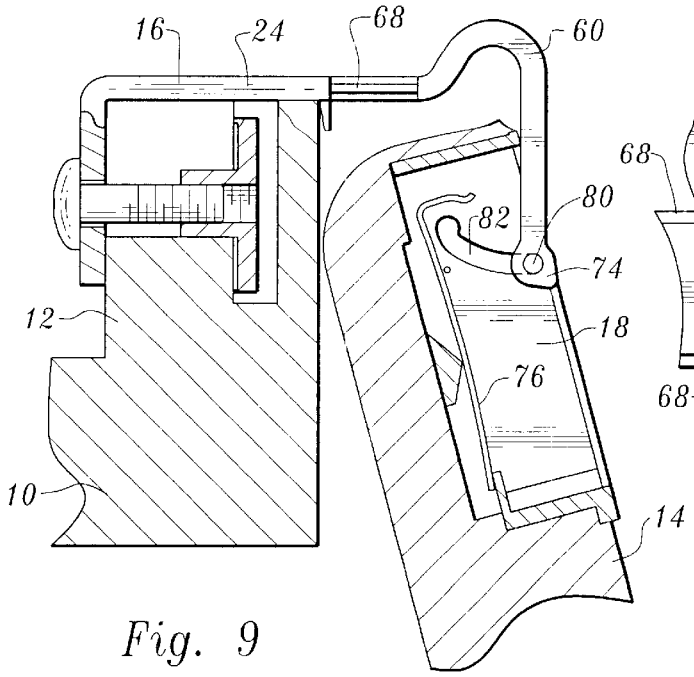
FIG. 9 is a view similar to FIG. 8 and showing the door being opened even further than shown in FIG. 8.
Figure 10:
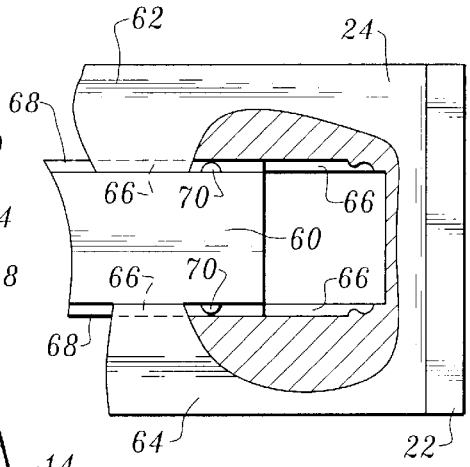
FIG. 10 is a view similar to FIG. 6 but illustrating the relative positions assumed by the selected components when the cabinet door is in the position shown in FIG. 9.

If the cabinet door and associated hinge member 18 are pivoted further away from the cabinet housing opening and the first hinge member 16 due to the application of forces thereto, the spring 76 will yield sufficiently to allow this. No potentially damaging strain is formed in the cabinet housing or cabinet door. This action is shown in FIG. 8 wherein the door 14 defines a greater angle with the front of the cabinet than it does in FIG. 5. The second hinge member 18 also defines a greater angle with respect to first hinge member 16 than it does in FIG. 5.

When the cabinet door 14 moves to such an extent that it engages the front of the cabinet housing (as shown in FIG. 8) it will cause pulling forces to be exerted on connector member 60. This, in turn, causes disengagement of the detents 70 from the indents of plate 24 and outward movement of the connector member 60 to the position shown in FIGS. 9–11. Thus, the strain on the cabinet housing is relieved even though the door has been opened beyond its normal position. Damage to the cabinet housing, the hinge and the cabinet door is thus prevented even though the door has pivoted in the order of 180 degrees.

It will be noted that the pins 80 projecting from cam 74 move in their associated slots 82 during movement of the cabinet door and its associated second hinge member 18. Thus, an interconnection between the connector member 60 and second hinge member 18 is maintained without interfering with the strain relieving operation of the device.

Figure 11:
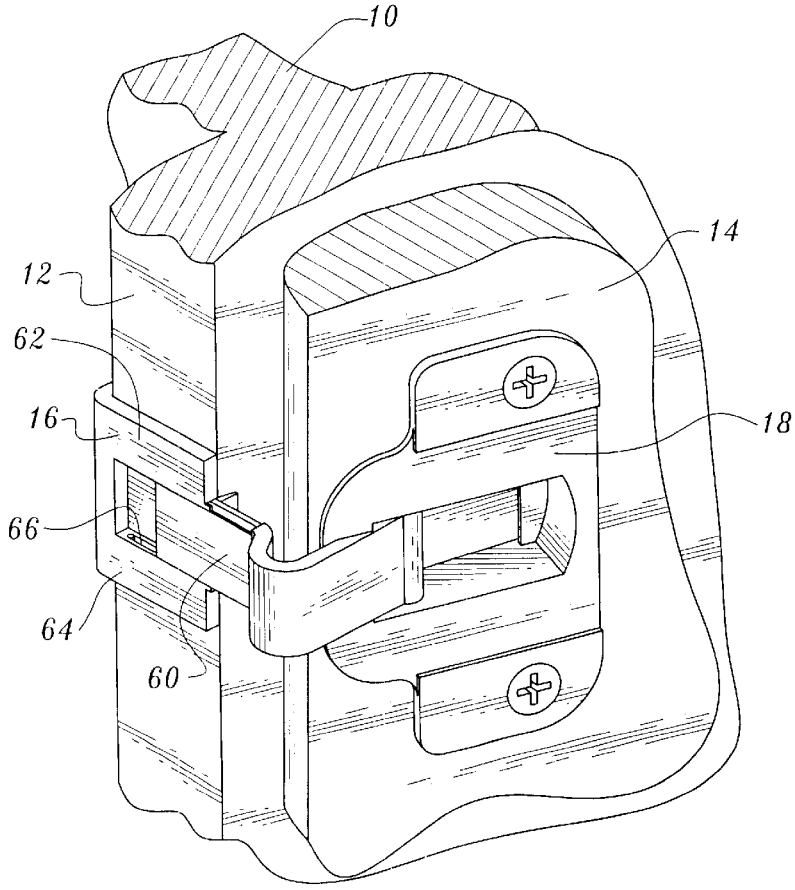
FIG. 11 is a perspective view illustrating the back side of the door and the relative positions assumed by the hinge members and connector when the door is positioned as shown in FIG. 9.
Figure 12:
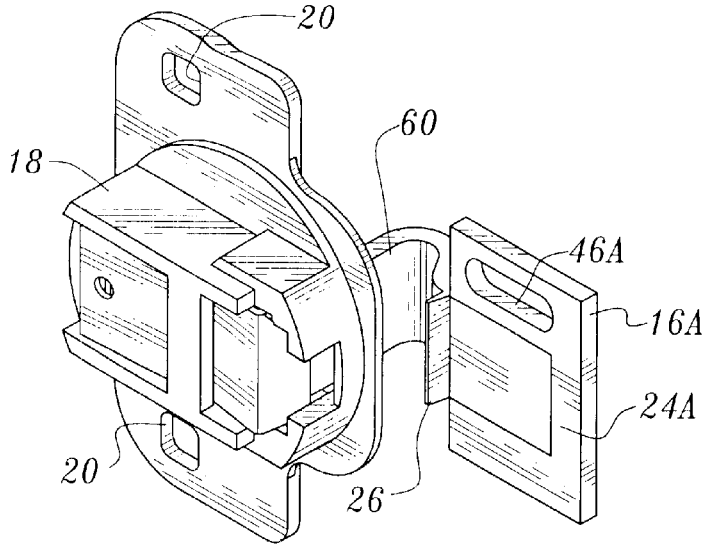
FIG. 12 is a view similar to FIG. 1 but illustrating an alternative embodiment of the invention.
Figure 13:
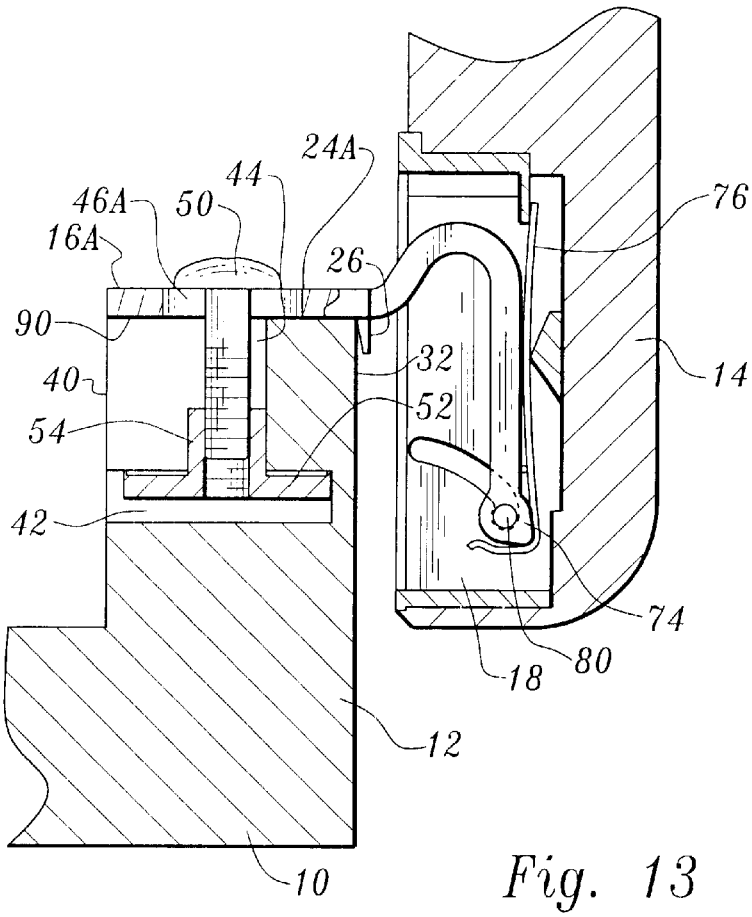
FIG. 13 is a view similar to FIG. 4 but illustrating the alternative embodiment installed on a cabinet.

FIGS. 11 and 12 disclose an alternative embodiment of the invention in which hinge member 16A comprises only a single plate, plate 24A. Mounting slot 46A is formed in plate 24A and has a horizontal orientation. This embodiment of the invention is mounted on the surface 90 of the end of frame member 12 defining the cabinet opening covered by the door 14. T-shaped opening 40 is formed at the back of the frame member. Slot 44 projects inwardly from the end of the frame member. Bolt 50 projects through opening 46A into the frame member to engage boss 54 projecting from fastener plate 52, the plate 52 and hinge member 16A clampingly engaging a portion of the frame member.

The invention claimed is:

1. In combination:

a cabinet having a cabinet housing defining a cabinet opening and a cabinet door for selectively covering said cabinet opening;

a first hinge member attached to the cabinet housing;

a second hinge member attached to said cabinet door; and connector means hingedly interconnecting said first hinge member and said second hinge member whereby said cabinet door may be pivoted relative to said cabinet housing between a closed position wherein said cabinet door covers said cabinet opening and a predetermined open position wherein said cabinet door does not cover said cabinet opening, said connector means including strain reliever means for relieving strain on said cabinet housing when said cabinet door has a force applied thereto when said cabinet door is in said predetermined open position further pivoting said cabinet door away from said cabinet opening and moving said cabinet door beyond said predetermined open position, said strain reliever means including a connector member telescopically connected to said first hinge member.

2. The combination according to claim 1 wherein said second hinge member defines a recess, said second hinge member positioned in an opening defined by said cabinet door; and said connector means additionally including pivot pins pivotally interconnecting said second hinge member to said connector member.

3. The combination according to claim 2 wherein said second hinge member defines slots communicating with said recess, said pivot pins projecting from said connector member and located in said slots.

4. In combination:

a cabinet having a cabinet housing defining a cabinet opening and a cabinet door for selectively covering said cabinet opening;

a first hinge member attached to the cabinet housing;

a second hinge member attached to said cabinet door; and connector means hingedly interconnecting said first hinge member and said second hinge member whereby said cabinet door may be pivoted relative to said cabinet housing between a closed position wherein said cabinet door covers said cabinet opening and a predetermined open position wherein said cabinet door does not cover said cabinet opening, said connector means including strain reliever means for relieving strain on said cabinet housing when said cabinet door has a force applied thereto when said cabinet door is in said predetermined open position further pivoting said cabinet door away from said cabinet opening and moving said cabinet door beyond said predetermined open position, said cabinet being a face frame cabinet including a cabinet wall and a frame member attached to said cabinet wall and projecting therefrom over a portion of the interior of said cabinet, said frame member having a frame member front, a frame member back and a frame member side disposed between said frame member front and said frame member back, said frame member side having a T-shaped opening formed therein having a vertical opening segment and an intersecting horizontal opening segment, said vertical opening segment communicating with a frame member recess in said frame member located between said frame member front and frame member back and said horizontal opening segment communicating with a slot formed in said frame member back, said slot having a vertical dimension less than the vertical dimension of said frame member recess, said first hinge member including a first plate and a second plate attached to said first plate and extending substantially orthogonal thereto, said second plate having a plate opening formed therein, said first plate disposed parallel and adjacent to said frame member side and covering said T-shaped opening and said second plate disposed parallel and adjacent to said frame member back and at least partially covering said slot, and fastener means fastening said first hinge member to said frame member, said fastener means comprising a bolt extending through said plate opening and into said slot and a fastener member disposed in said frame member recess and threadedly engaged with said bolt, a portion of said frame member defining said slot clampingly engaged between said second plate and said fastener member.

5. The combination according to claim 4 wherein said fastener member includes a fastener plate bearing against said portion of said frame member and a threaded boss projecting from said fastener plate into said slot.

6. The combination according to claim 4 wherein said plate opening comprises a vertically disposed, elongated mounting slot.

7. In combination:

a cabinet having a cabinet housing defining a cabinet opening and a cabinet door for selectively covering said cabinet opening;

a first hinge member attached to the cabinet housing;

a second hinge member attached to said cabinet door; and connector means hingedly interconnecting said first hinge member and said second hinge member whereby said cabinet door may be pivoted relative to said cabinet housing between a closed position wherein said cabinet door covers said cabinet opening and a predetermined open position wherein said cabinet door does not cover said cabinet opening, said connector means including strain reliever means for relieving strain on said cabinet housing when said cabinet door has a force applied thereto when said cabinet door is in said predetermined open position further pivoting said cabinet door away from said cabinet opening and moving said cabinet door beyond said predetermined open position, said strain reliever means including yieldable stop means for yieldably retaining said cabinet door at said predetermined open position, said yieldable stop means including a cam projecting from said connector member and a spring yieldably engaging said cam during pivoting of said cabinet door.

* * * * *